United States Patent [19]

Hess

[11] Patent Number: 4,569,257

[45] Date of Patent: Feb. 11, 1986

[54] COLLAR UNTHREADER

[76] Inventor: Charles H. Hess, P.O. Box 163, Ventura, Calif. 93002

[21] Appl. No.: 713,809

[22] Filed: Mar. 20, 1985

[51] Int. Cl.[4] ..... B25B 13/50

[52] U.S. Cl. ..... 81/53.2

[58] Field of Search ..... 81/53.2, 3.07, 3.29, 81/3.4, 3.42, 3.44; 279/96, 102

[56] References Cited

U.S. PATENT DOCUMENTS

| | | | |
|---|---|---|---|
| 348,185 | 8/1886 | Bowman | 81/53.2 |
| 1,516,602 | 11/1924 | Hill | 81/53.2 |
| 1,815,363 | 7/1931 | Bootor | 81/53.2 |

*Primary Examiner*—James L. Jones, Jr.
*Attorney, Agent, or Firm*—John E. Kelly

[57] ABSTRACT

Apparatus for unthreading collars from casing and tubing or the like employed in bore holes, and including a chuck adaptor to be mounted on a lathe. The chuck adaptor has a shaft which is held by the chuck of the lathe. The shaft carries the housing in which three eccentrically apertured contiguous rings are mounted. The center ring is rotatable in the housing whereas the two other rings are fixed therein. A slot is provided through the housing at the position of the center ring. A handle-like projection extends from the exterior of the housing through the slot and is threaded into the rotatable ring. Gripping dies are carried internally of the rotatable ring. The fixed rings hold the collar while the center ring is rotated by rotating the projection to cause the gripping dies to seize upon the collar. The lathe turns the adaptor while a wrench engaged with the pipe threaded to the collar may be held stationary. The center ring is turned about an axis which is eccentric to that of the aperture therethrough.

8 Claims, 7 Drawing Figures

COLLAR UNTHREADER

BACKGROUND OF THE INVENTION

This invention relates to bucking machines or the like, and more particularly to means for unthreading collars from casing or tubing or the like employed, for example, in the drilling of or in the production of oil wells.

PRIOR ART STATEMENT

A patentability search of the present invention was made before this application was prepared or filed. The following patents were cited in this search (U.S. Pat. Nos.):

| | |
|---|---|
| Ehrich | 2,276,945 |
| Zipser | 2,432,059 |
| Faust | 2,456,776 |
| Mazzola | 2,576,350 |
| Barbier et al | 2,793,041 |
| Burton | 2,869,879 |
| Grunbaum | 3,073,632 |
| Komori | 3,815,928 |
| Seitz | 4,315,585 |

None of these patents are believed to be material. However, the following comments are offered as being of interest.

Ehrich is entitled "Adjustable Holding Device" and discloses an eccentric hub 30.

Zipser discloses a locking device for tripod legs including an eccentric bore 26.

Faust discloses a device entitled "Eccentric Chuck" including a ring 43 with an eccentric bore.

Mazzola discloses a structure entitled "Spring Chucking Device" including a split eccentric sleeve 1.

Barbier et al discloses a machine tool fixture including a sleeve 30 having an eccentric hole 31 therethrough.

Burton, in column 20, line 59, etc. says that "The reference numeral 20 generally designates an eccentric outer adjusting collet or sleeve of elongated tubular outline . . . ".

In Grunbaum, two eccentrics 1 and 2 are shown in FIG. 2, and described in column 1, lines 37 and 38.

Komori, in column 2, lines 23–25, discloses "The ring 8 has an inner cylindrical surface 20 having a center 22 which is eccentrically displaced . . . ".

Seitz discloses a cylindrical section 62 in FIG. 5 which has an eccentric bore.

SUMMARY OF THE INVENTION

In accordance with the device of the present invention, the above-described and other disadvantages of the prior art are overcome by providing a chuck adaptor which securely seizes upon a casing or tubing collar.

BRIEF DESCRIPTION OF THE DRAWINGS

In the drawings which are to be regarded as merely illustrative.

DESCRIPTION OF THE PREFERRED EMBODIMENT

Figure 1:
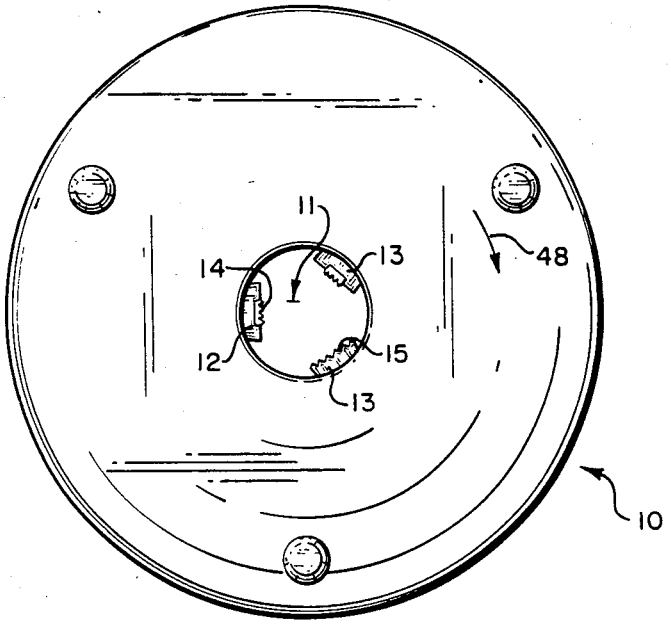
FIG. 1 is a front elevational view of a conventional lathe.

In the drawings, in FIG. 1, a conventional lathe 10 is shown having a conventional chuck 11 with conventional jaws 12 and 13. Jaws 12 and 13 have conventional dies 14 and 15, respectively.

Figure 2:
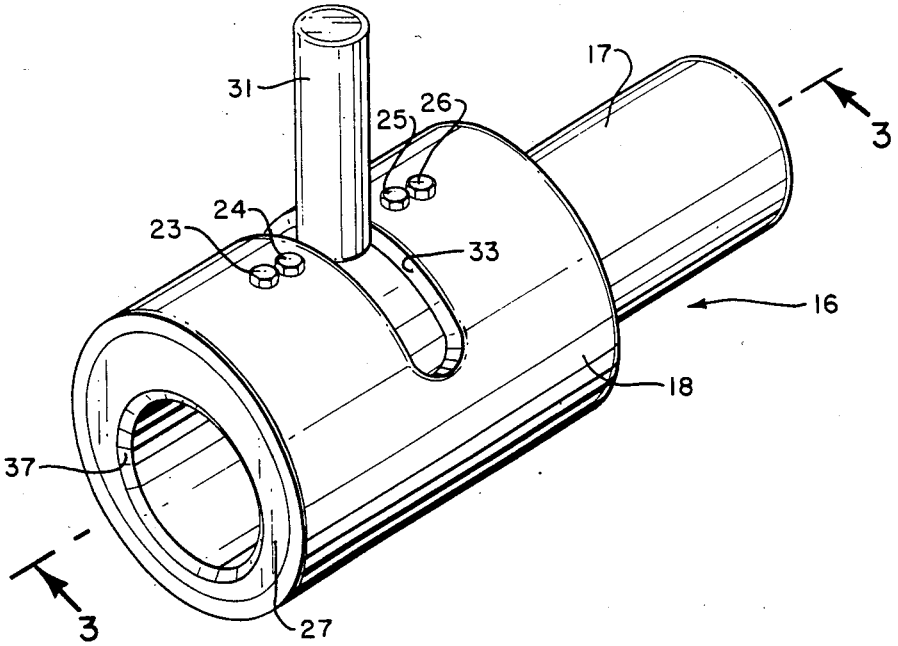
FIG. 2 is a perspective view of a chuck adaptor constructed in accordance with the present invention.

The chuck adaptor of the present invention is shown at 16 in FIG. 2 including a shaft 17 which is fixed in position within jaws 12 and 13 of chuck 11.

Chuck adapter 16 includes a housing 18 to which shaft 17 is fixed. Housing 18 has holes 19–22 through which cap screws 23–26 are threaded into rings 27 and 28 (see FIGS. 2 and 3). Screws 23 and 24 are threaded into ring 27. Screws 25 and 26 are threaded into ring 28.

Figure 3:
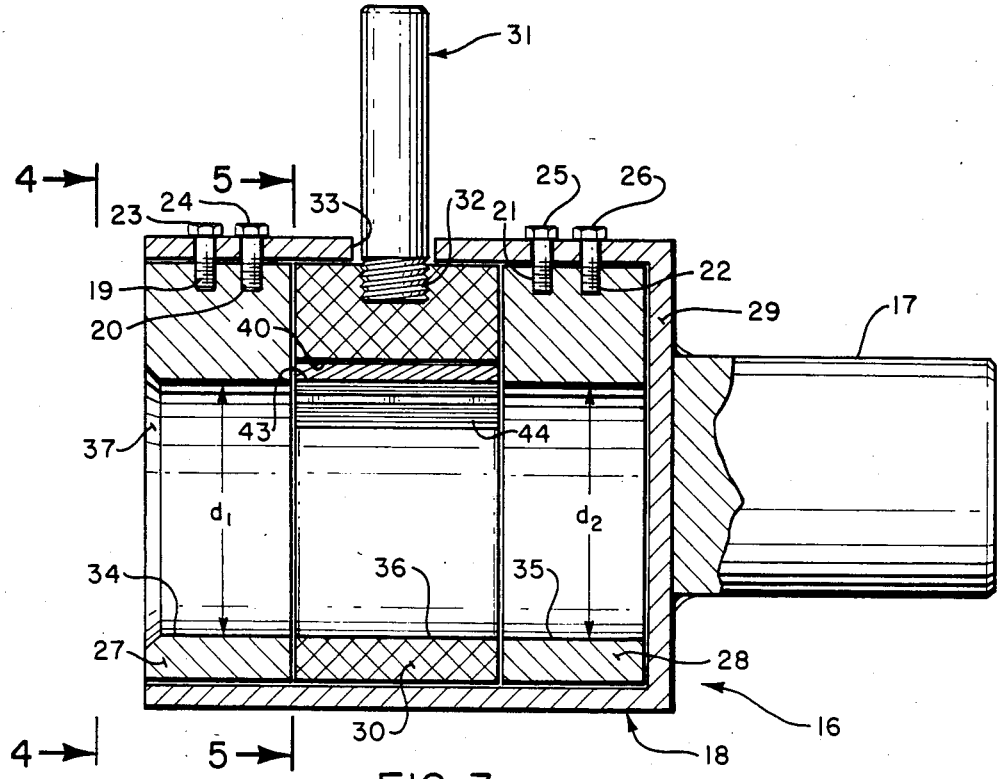
FIG. 3 is a longitudinal sectional view of a chuck adaptor taken on the line 3—3 shown in FIG. 2.

As shown in FIG. 3, chuck adaptor 16 has one end closed by a wall 29 to which shaft 17 is fixed.

Center ring 30 is provided rotatable between rings 27 and 28. A handle 31 is threaded into ring 30 at 32.

Housing 18 has a slot 33 which may project around the axis of housing 18 180° or less.

Rings 27, 28 and 30 have respective internal bores 34, 35 and 36 of diameters $d_1$, $d_2$ and $d_3$ where $d_1=d_2$ and $d_2=d_3$.

The left end of bore 34 is beveled at 37 as shown in FIGS. 2–3.

Figure 4:
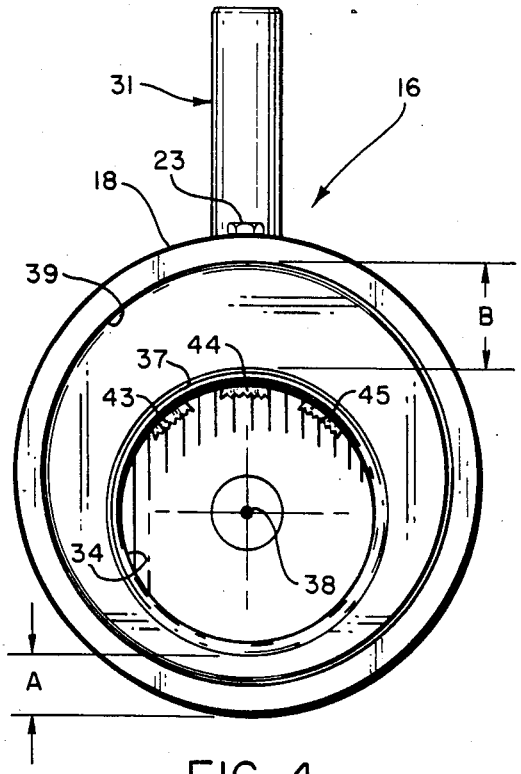
FIG. 4 is a left end elevational view of the chuck adaptor taken on the line 4—4 shown in FIG. 3.

In FIG. 4, note that axis 38 of bore 34 is eccentric to the axis of the housing bore 39. Note, concerning the dimensions A and B, that A is larger than B.

Figure 5:
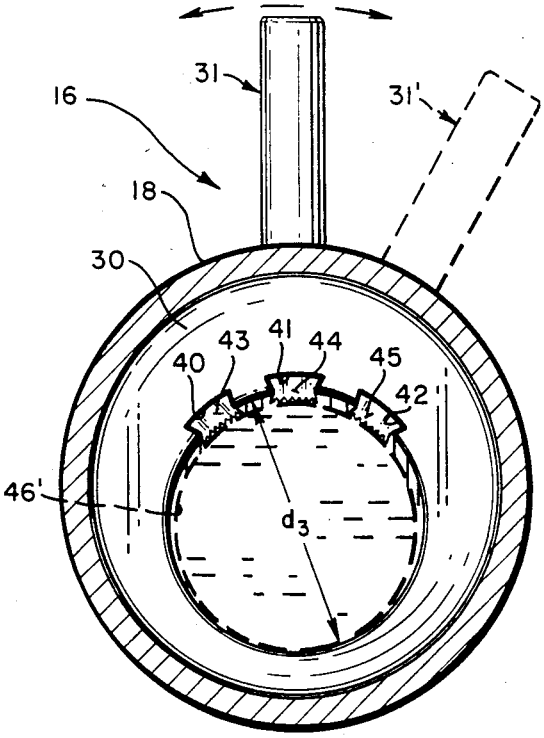
FIG. 5 is a transverse sectional view of the chuck adaptor taken on the line 5—5 shown in FIG. 3.

In FIG. 5, ring 30 has key ways 40–42 with respective gripping dies 43–45 fixed therein.

When a collar is first located within ring 30, it may appear as indicated in the dotted line 46'.

Figure 6:
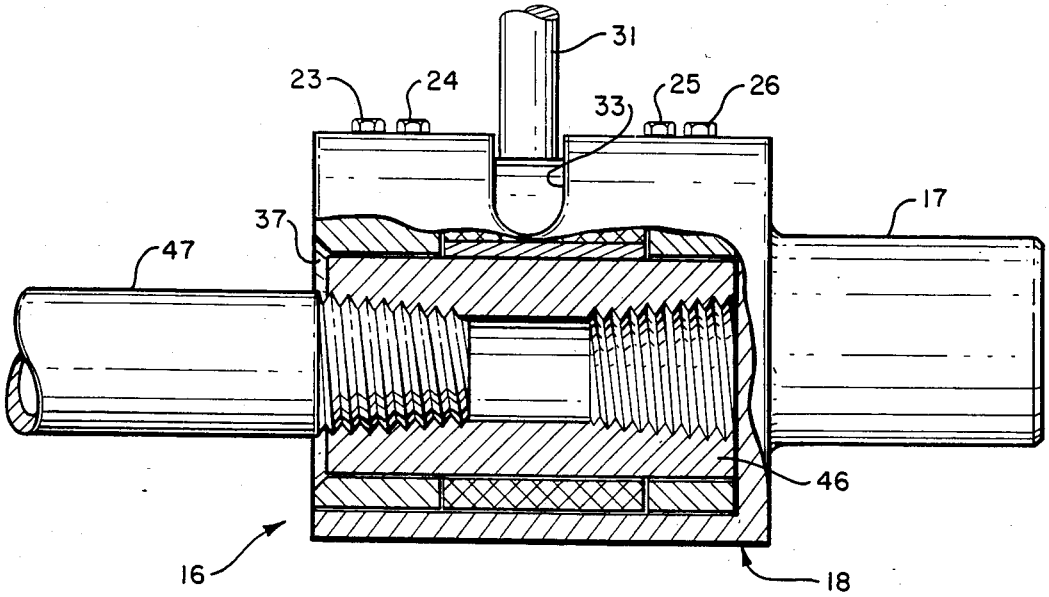
FIG. 6 is an enlarged longitudinal sectional view of the chuck adaptor similar to that of FIG. 3 shown with a collar therein.

A collar 46 and a pipe 47 threaded thereto are shown with collar 46 seized in chuck adaptor 16 in FIG. 6.

Figure 7:
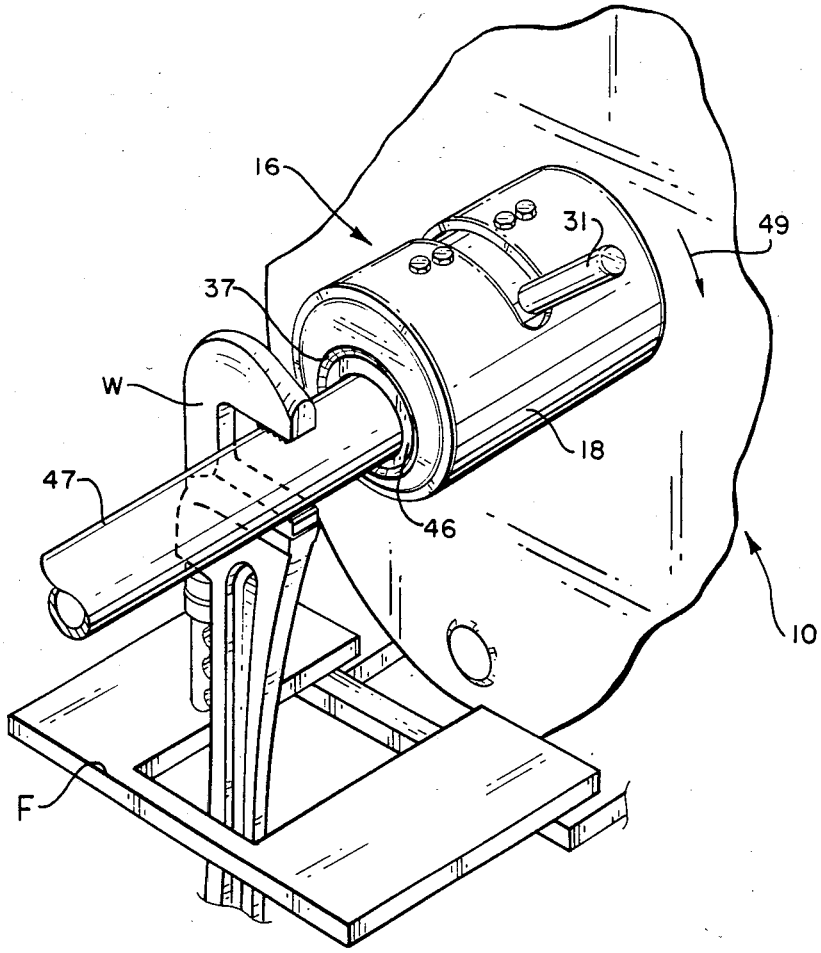
FIG. 7 is a perspective view of the chuck adaptor mounted in the main chuck of the lathe, and having a pipe with a collar mounted in the adaptor.

FIG. 7 shows chuck adaptor 16 with shaft 17 seized within the jaws 12 and 13 of lathe chuck 11. In this case, gripping dies 43–45, which are per se conventional and may be the same as those carried by jaws 12 and 13, bite into the external surface of collar 46. This is true because handle 31 has been rotated to the dotted line position 31' shown in FIG. 4. For this rotation, chuck 11 should be driven to rotate in the direction indicated by arrows 48 and 49 in FIGS. 1 and 7, respectively.

In other words, the movement of handle 31 should be in the same direction as arrows 48 and 49 or vice versa.

In operation, handle 31 is turned after collar 46 has been loaded, but before lathe 10 is turned on.

Note will be taken that when collar 46 is loaded inside all of the rings 27, 28 and 30, bores 34, 35 and 36 lie in registration. On the other hand, when handle 31 is rotated to the dotted line position 31' in FIG. 5, bores 34, 35 and 36 no longer lie in precise registration and dies 43–45 bite into the exterior surface of collar 46.

Note that when lathe 10 is turned on, the more unthreading force that is used, the further the dies 43–45 will penetrate the metal external surface of the collar 46 making it impossible for the collar 46 to turn inside chuck adaptor 16.

Incidentally, the chuck adaptor 16 of the present invention may be assembled by sliding in rings 28, 30 and 27 in that order without cap screws 23–26 or handle 31 threaded into the rings. Cap screws 23–26 and handle 31 may then be threaded into positions shown in FIG. 3.

In FIGS. 1 and 7, note will be taken that pipe 47 is not permitted to move when wrench W engages framing F and lathe 10 rotates chuck 11 in the direction of arrows 48 and 49.

What is claimed is:

1. Apparatus for unthreading casing, tubing and drill collars or the like, said apparatus comprising:

a high torque lathe having a chuck;

a chuck adaptor for a collar having a cylindrical shaft fixed in said chuck, said adaptor including a hollow housing closed at one of its ends, open at its other end, and having a cylindrical surface, the external surface of said housing closed end being fixed relative to said shaft in a position concentric therewith, said housing having an arcuate slot through the cylindrical wall thereof spaced from each end thereof;

a first ring fixed relative to said housing inside thereof between said slot and said housing closed end;

a second ring fixed relative to said housing inside thereof between said slot and said housing open end; and a third ring rotatable against said housing internal surface in the vicinity of said slot, said third ring having lever means fixed thereto and projecting radially through and outwardly of said slot;

said first and second rings having concentric internal cylindrical surfaces of substantially the same diameter, said first and second ring internal surfaces being eccentric to said housing internal surface, said third ring having a cylindrical internal surface eccentric to said housing internal surface and rotatable by said lever means to and from a position in alignment with the internal surfaces of said first and second rings.

2. The invention as defined in claim 1, wherein:

said housing closed end has a substantially flat internal surface, each of said rings having substantially flat and parallel sides normal to the respective internal surfaces thereof, one of said first ring sides being in engagement with said housing closed end internal surface said third ring sides lying in slidable engagement with respective sides of said first and second rings, said first and second rings having cylindrical external surfaces in engagement with said housing internal cylindrical surface, said third ring having a cylindrical external surface rotatable in engagement with said housing internal surface, said third ring having axial keyways in said cylindrical internal surface thereof; and gripping dies in the shape of keys in said keyways.

3. The invention as defined in claim 2, wherein:

said lever means includes a projection threaded into said third ring, said screw means being threaded through the wall of said housing into engagement with said first and second rings;

the external edge of said second ring internal surface being beveled, said lathe having a framing; and a wrench for attachment to a pipe and engageable with said framing to prevent rotation of said pipe.

4. Apparatus for unthreading drill collars or the like, said apparatus comprising:

a chuck adaptor having a shaft, said adaptor including a hollow housing closed at one of its ends, open at its other end, and having a cylindrical internal surface, said housing closed end being fixed relative to said shaft, said housing having an arcuate slot through the wall thereof spaced from each end thereof;

a first ring fixed relative to said housing inside thereof between said slot and said housing closed end;

a second ring fixed relative to said housing inside thereof between said slot and said housing open end; and a third ring rotatable against said housing internal surface in the vicinity of said slot, said third ring having lever means fixed thereto and projecting radially through and outwardly of said slot, said first and third rings having concentric internal cylindrical surfaces of substantially the same diameter;

said first and third ring internal surfaces being eccentric to said housing internal surface, said third ring having a cylindrical internal surface eccentric to said housing internal surface and rotatable by said lever means to and from a position in alignment with the internal surfaces of said first and second rings, said third ring having an external cylindrical surface rotatable in engagement with said housing internal surface, said chuck adaptor being capable of holding a cylindrical body when the same is placed inside said first, second and third rings, and said third ring is turned via said lever means.

5. The invention as defined in claim 4, wherein:

gripping dies are fixed relative to said third ring inside said internal surface thereof.

6. The invention as defined in claim 5, wherein:

said gripping dies are positioned around said third ring opposite the side on which the narrowest radial dimension thereof is positioned.

7. The invention as defined in claim 6, wherein:

keyways are disposed in said third ring internal surface, and said gripping dies are wedged in said keyways.

8. The invention as defined in claim 4, wherein:

said housing has a cylindrical internal surface of revolution about a first axis, said third ring having a cylindrical internal surface of revolution about a second axis spaced from said first axis in a direction therefrom opposite the side on which said lever means is located.

* * * * *